US005309342A

United States Patent [19]

Heinen, Sr.

[11] Patent Number: 5,309,342

[45] Date of Patent: May 3, 1994

[54] RECESSED LIGHTING FIXTURE

[75] Inventor: James J. Heinen, Sr., Vernon Hills, Ill.

[73] Assignee: Cooper Industries, Inc., Houston, Tex.

[21] Appl. No.: 25,248

[22] Filed: Mar. 2, 1993

[51] Int. Cl.[5] ..... F21S 1/02

[52] U.S. Cl. ..... 362/364; 362/147; 362/365; 362/396; 362/455

[58] Field of Search ..... 362/147, 148, 282, 307, 362/364, 365, 374, 375, 396, 433, 434, 455

[56] References Cited

U.S. PATENT DOCUMENTS

| | | | |
|---|---|---|---|
| 843 | 0/1903 | Oldfield | 362/375 |
| 1,002,592 | 9/1911 | Little, Jr. | 362/433 |
| 1,186,605 | 6/1916 | Pfeifer | 362/374 |
| 1,255,163 | 2/1918 | Hager | 362/433 |
| 1,743,847 | 1/1930 | Doane | 362/433 |
| 1,746,339 | 2/1930 | Doane | 362/433 |
| 1,931,343 | 10/1933 | Cook et al. | 362/364 |
| 1,939,295 | 12/1933 | Douglas . | |
| 2,630,522 | 3/1953 | MacDougall | 362/364 |
| 2,639,368 | 5/1953 | Pryne | 362/364 |
| 2,673,291 | 3/1954 | Moss | 362/364 |
| 2,845,855 | 8/1958 | Burns | 362/365 |
| 3,018,082 | 1/1962 | Berger | 362/365 |
| 3,044,106 | 7/1962 | Papsdorf | 362/364 |
| 3,154,001 | 10/1964 | Zurawski | 362/148 |
| 3,524,981 | 8/1970 | Auerbach | 362/433 |
| 3,697,743 | 10/1972 | Eargle | 362/374 |
| 4,520,435 | 5/1985 | Baldwin | 362/455 |
| 4,754,377 | 6/1988 | Wenman | 362/148 |

FOREIGN PATENT DOCUMENTS

| | | | |
|---|---|---|---|
| 1218176 | 12/1959 | France | 362/374 |

*Primary Examiner*—Richard R. Cole
*Assistant Examiner*—Y. Quach
*Attorney, Agent, or Firm*—Burns, Doane, Swecker & Mathis

[57] ABSTRACT

A recessed lighting trim comprises a reflector, a circular frame connected to the reflector, and a circular translucent plate mounted in the frame. The translucent plate is retained in the plate by tabs of the frame which are bent onto the translucent plate. The frame includes hooks adapted to be received in slots formed in the reflector to enable the frame to be installed and removed by being rotated relative to the reflector. A chain connects the frame to the reflector to prevent the frame from falling after being removed from the reflector.

8 Claims, 3 Drawing Sheets

FIG. 1
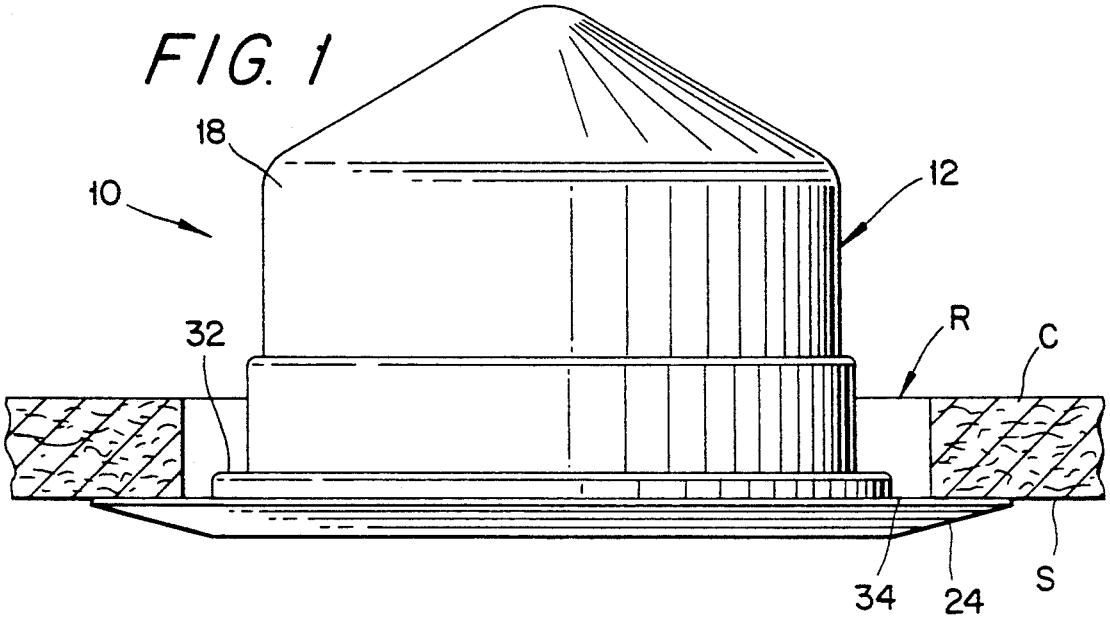
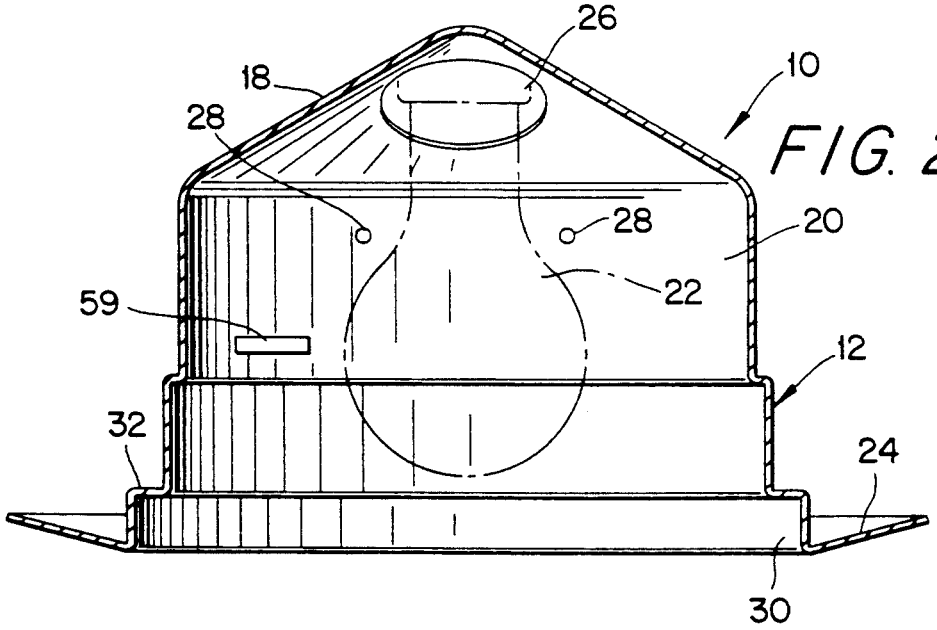
FIG. 2
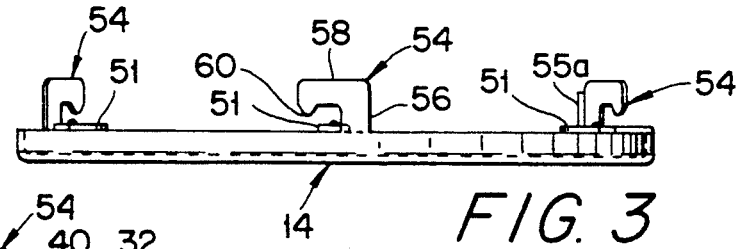
FIG. 3
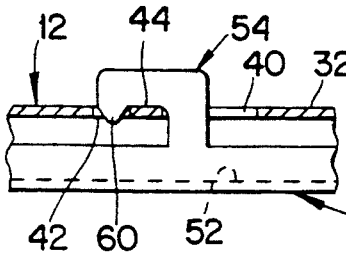
FIG. 4

RECESSED LIGHTING FIXTURE

BACKGROUND OF THE INVENTION

The present invention relates to a recessed lighting fixture and, in particular, to a connecting arrangement between a reflector and a frame for carrying a translucent body.

Recessed lighting fixtures are conventional which comprise a metal reflector mounted in a ceiling recess so as to form a chamber in which a lamp is received. The chamber has a circular opening at its lower end, and a translucent plate extends across the opening. The plate is carried by a frame which is removably mounted to the reflector. When the lamp requires replacement, it is often necessary to pull the entire reflector from the ceiling which involves an undesirable amount of effort and involves a risk of damage to the translucent plate.

It would be desirable to provide a recessed ceiling fixture which facilitates the replacement of a lamp in a rapid manner with minimal risk of damage to the translucent plate.

SUMMARY OF THE INVENTION

The present invention relates to a recessed lighting trim comprising a reflector, a frame connected to the reflector, and a translucent member mounted in the frame. The reflector comprises a body formed of a downwardly open chamber for receiving a lamp. The body includes a main upper portion sized to fit within a ceiling housing and having a hole for accommodating passage of electrical wiring. A flange extends laterally outwardly from a lower edge of the body for bearing against a ceiling surface. The body includes a generally circular recess surrounded by the flange and bordered at its upper end by a laterally extending shoulder.

The shoulder includes a plurality of circumferentially spaced, circumferentially extending slots. The frame comprises a frame body sized to fit within the recess of the reflector body. The frame body includes a generally circular ring-shaped rim, and a plurality of circumferentially spaced hooks extending upwardly from the rim. A circumferential spacing between the hooks correspond to a circumferential spacing between the slots. Each hook is of inverted shape. Each hook is sized to fit through a respective one of the slots to permit the frame to be rotated in a first direction of rotation relative to the reflector and then lowered such that the hooks become hooked over respective retaining portions of the shoulder to mount the frame in the reflector. The frame is removable from the reflector in response to being raised and rotated in a second direction to return the hooks into alignment with the respective slots. A safety connector interconnects the frame and the reflector to permit relative rotation therebetween and permit limited lowering of the frame relative to the reflector.

Preferably, the slots constitute main slots. A plurality of secondary slots is provided, with the secondary slots being associated with respective main slots. Each main slot is spaced from its respective secondary slot by one of the retaining portions of the shoulder. The hooks extend downwardly into respective secondary slots when the frame is mounted in the reflector.

Preferably, the safety connector comprises a flexible line, such as a chain.

The frame preferably includes a plurality of tabs which can be bent downwardly over the translucent member to retain the latter in the frame.

Each tab preferably includes a bump arranged to project upwardly when the tabs have been bent downwardly. The bumps are engageable with the shoulder, when the frame is raised, to create point contacts between the frame and shoulder during rotation of the latter.

BRIEF DESCRIPTION OF THE DRAWINGS

The objects and advantages of the invention will become apparent from the following detailed description of a preferred embodiment thereof in connection with the accompanying drawings in which like numerals designate like elements, and in which:

FIG. 1 is a side elevational view of a recessed lighting trim according to the present invention;

FIG. 2 is a vertical sectional view through a reflector body of the lighting fixture;

FIG. 3 is a side elevational view of a frame component in which a translucent plate is mounted;

FIG. 4 is a fragmentary sectional view depicting a hook part of the frame attached to the reflector;

DETAILED DESCRIPTION OF A PREFERRED EMBODIMENT OF THE INVENTION

Figure 6:
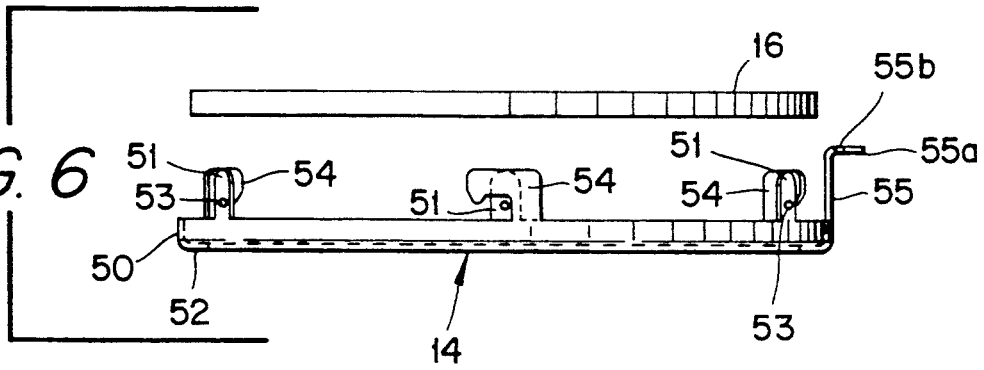
FIG. 6 is an exploded view of the frame and translucent plate.

A recessed lighting trim 10 comprises a reflector 12, a frame 14 connected to the reflector, and a translucent light diffuser 16 (e.g., a glass plate) carried by the frame (see FIG. 6). The reflector 12 is preferably made of a metal body such as aluminum and forms a downwardly open chamber 20 for receiving a lamp 22. The reflector body includes a dome-shaped main upper portion 18, and a lateral flange 24 which projects laterally outwardly from a- lower edge of the chamber 20. The dome-shaped portion 18 is sized to fit within a recess R of a ceiling C.

A hole 26 is formed in the upper portion 18 for receiving a socket to which the lamp 22 is attached, and a plurality of smaller holes 28 which receive rivets (not shown) that fasten the reflector to a bracket. The flange 24 bears against a surface S of the ceiling to conceal the recess R.

Figure 8:
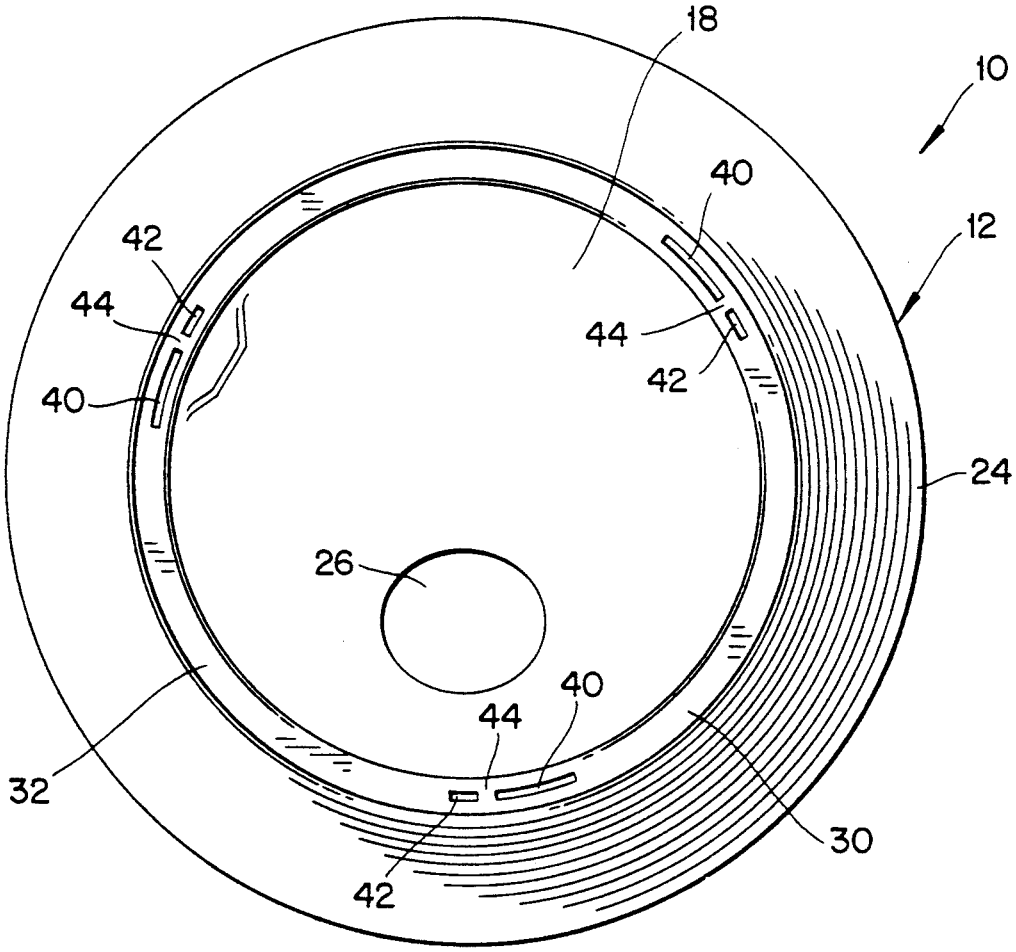
FIG. 8 is a bottom plan view of the reflector depicted in FIG. 2.

A recess 30 of the reflector (see FIG. 2) is surrounded by the flange 24 and is bordered at its upper end by a lateral shoulder 32 of the reflector. That shoulder 32 is disposed above an upper edge 34 of the flange 24 so as to be disposed within the ceiling recess R. A plurality of slots 40, 42 is formed in that shoulder as depicted in FIG. 8). In particular, three arc-shaped long slots 40 and three arc-shaped short slots 42 are formed so as to extend completely through the shoulder 32. Each long slot 40 is paired with a short slot 42. Each pair of long and short slots 40, 42 is spaced circumferentially by 120° from the other pairs of slots. It will be appreciated that the slots 40, 42 of each pair of slots are separated by a portion 44 of the shoulder 32.

The frame 14 can be formed of any suitable material, such as cold rolled steel. The frame 14 comprises a body sized to fit within the recess 30 of the reflector. The frame 14 is in the form of a circular ring-shaped body which has a cylindrical rim or side wall 50 and a radially inwardly projecting lip 52 (see FIG. 6). Projecting from an upper edge of the side wall 50 are three tabs 51 which initially project upwardly as depicted in FIG. 6. However, the tabs are capable of being bent downwardly onto the translucent plate 16 to retain the latter, as depicted in FIGS. 3 and 5.

Each tab 51 includes a projection or bump 53 arranged to project upwardly when the tabs have been bent onto the plate 16 for reasons to be explained.

Figure 5:
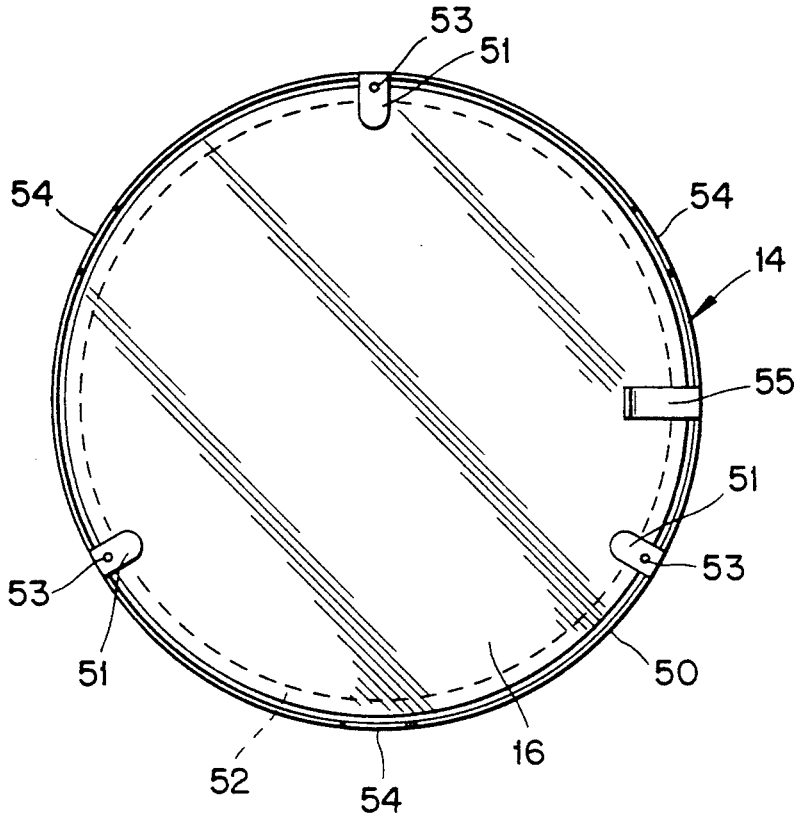
FIG. 5 is a top plan view of the frame and translucent plate shown in FIG. 3.
Figure 7:
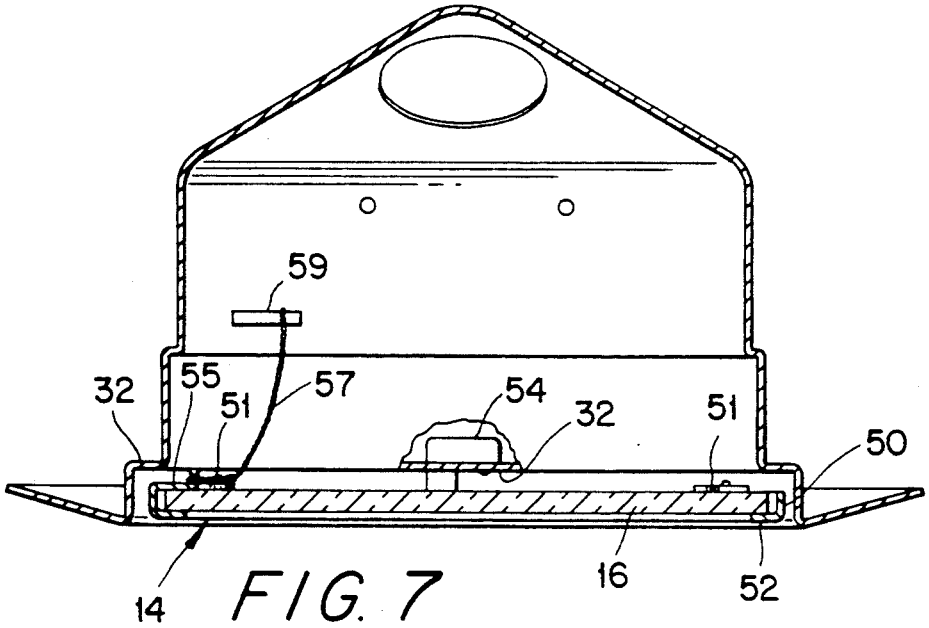
FIG. 7 is a vertical section through the recessed fixture according to the invention.

Also projecting from the side wall 50 is a bracket 55 which initially projects upwardly (see FIG. 6), but which can be bent downwardly onto the plate 16 (see FIGS. 3, 5 and 7). The bracket 55 includes an angled end 55*a* having a hole 55*b* therein. The hole is able to receive an end of a flexible line such as a chain 57 (see FIG. 7). The chain can be secured to the bracket 55 in any suitable fashion, such as by welding. The other end of the chain is affixed to clip and slips into bracket 59 formed by a bent portion of the reflector.

Also projecting from the upper edge of the side wall 50 are three hooks 54 which are spaced circumferentially apart by one-hundred twenty degrees. Each hook includes an upright post 56, a lateral arm 58 extending from an upper end of the post, and a finger 60 projecting downwardly from an end of the arm 58, thereby forming an inverted U-shaped hook. The hooks 54 are dimensioned to pass through the longer slots 40 of the reflector 12, whereupon the frame 14 can be rotated forwardly relative to the reflector about a vertical axis until the fingers 60 overlie the shorter slots 42 of the reflector. Then, by permitting the frame to descend, the fingers 60 will enter those slots 42. Accordingly, the arms 58 will overlie the portions 44 of the shoulder 32 to vertically support the frame 14, as depicted in FIGS. 4 and 7. In order to remove the frame 14, it is merely necessary to raise the frame to free the fingers 60 from the shorter slots 42 and then rotate the frame rearwardly until the hooks 54 become aligned with the longer slots 40. Then, by permitting the frame to descend, it will become removed from the reflector to permit the lamp to be replaced.

In order to facilitate rotation of the fingers past the edges of the portion 44, the front and rear sides of each finger are beveled as depicted in FIG. 4.

As observed earlier, the tabs 51 carry bumps 53 which project upwardly once the tabs have been bent downwardly. When the frame is raised to release the fingers 60 from the slots 42, the bumps 53 will engage the underside of the shoulder 32 to minimize the size of contact area occurring between the frame and reflector and thereby minimize the frictional resistance to turning of the frame 14. It will be appreciated that the three bumps 53 ensure that only a three-point contact occurs between the frame and reflector during turning of the frame.

Once the hooks 54 have left the slots 40, there is no chance for the frame 14 to accidentally fall onto the floor and break, due to the presence of the chain 57.

It will be appreciated that the present invention enables the re-lamping to be performed without having to remove the reflector. In particular, the translucent plate 16 is removed in a quick and safe manner.

Although the invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. A recessed lighting trim comprising a reflector, a frame connected to said reflector, and a translucent member mounted in said frame, said reflector comprising a body forming a downwardly open chamber for receiving a lamp, said body including:

a main upper portion sized to fit within a ceiling recess and having a hole for accommodating passage of electrical wiring, a flange extending laterally outwardly from a lower edge of said body for bearing against a ceiling surface, and a generally circular recess surrounded by said flange and bordered at its upper end by a laterally extending shoulder, said shoulder including a plurality of circumferentially extending slots which are spaced apart in a circumferential direction said frame comprising a frame body sized to fit within said recess of said reflector body, said frame body including:

a generally circular ring-shaped rim, and a plurality of circumferentially spaced hooks extending upwardly from said rim, a circumferential spacing between said hooks corresponding to a circumferential spacing between said slots, each hook being of inverted U-shape, each hook being sized to fit through a respective one of said slots to permit said frame to be rotated in a first direction of rotation relative to said reflector body and then lowered such that said hooks become hooked over respective retaining portions of said shoulder to mount said frame in said reflector, said frame being removable from said reflector body in response to being raised and reverse-rotated in a second direction of rotation to return said hooks into alignment with said respective slots, a safety connector interconnecting said frame and said reflector to permit relative rotation therebetween and permit limited lowering of said frame relative to said reflector.

2. The recess lighting trim according to claim 1, wherein said slots constitute main slots, a plurality of secondary slots being associated with respective main slots, each main slot being spaced from its respective secondary slot by one of said retaining portions of said shoulder, said hooks extending downwardly into respective secondary slots when said frame is mounted in said reflector.

3. The recess lighting trim according to claim 1, wherein said safety connector comprises a flexible line.

4. The recess lighting trim according to claim 3, wherein said flexible line comprises a chain.

5. The recess lighting trim according claim 2, wherein each hook includes an upstanding post, a lateral arm, and a downwardly extending finger, said fingers extending into said secondary slots when said frame is mounted to said reflector.

6. The recess lighting trim according to claim 1, wherein said frame includes a plurality of tabs which extending upwardly from said rim and can be bent downwardly over said translucent member to retain the latter in said frame.

7. The recess lighting trim according to claim 6, wherein each tab includes a bump arranged to project upwardly when said tabs have been bent downwardly, said bumps being engageable with said shoulder, when said frame is raised to create point contacts between paid frame and said shoulder during rotation of the frame.

8. The recess lighting trim according to claim 1, wherein said frame includes a bracket which extending upwardly from said rim and can be bent downwardly upon said translucent member, said safety connector being connected to said bracket.

* * * * *